United States Patent [19]

Mitchell et al.

[11] 4,157,245

[45] Jun. 5, 1979

[54] COUNTERCURRENT PLUG-LIKE FLOW OF TWO SOLIDS

[75] Inventors: David S. Mitchell; David R. Sageman, both of San Rafael, Calif.

[73] Assignee: Chevron Research Company, San Francisco, Calif.

[21] Appl. No.: 802,999

[22] Filed: Jun. 3, 1977

Related U.S. Application Data

[63] Continuation-in-part of Ser. No. 670,925, Mar. 26, 1976, abandoned.

[51] Int. Cl.[2] ..... C10J 3/46; C10J 3/54; C10B 49/22

[52] U.S. Cl. ..... 48/197 R; 34/10; 48/202; 48/DIG. 4; 134/25 R; 201/12; 201/16; 201/31; 208/8 R; 208/11 R; 423/659; 423/DIG. 16; 432/197

[58] Field of Search ..... 48/197 R, 202, 206, 48/210, DIG. 4; 208/8, 11 R; 201/12, 16, 31; 432/197; 423/659 F, DIG. 16; 252/373; 34/10, 57 A; 134/25 R

[56] References Cited

U.S. PATENT DOCUMENTS

| | | | |
|---|---|---|---|
| 2,533,026 | 12/1950 | Matheson | 423/659 F |
| 2,557,680 | 6/1951 | Odell | 201/12 |
| 2,631,921 | 3/1953 | Odell | 423/659 F |
| 2,673,177 | 3/1954 | Buell | 201/12 |
| 2,701,758 | 2/1955 | Danulat et al. | 48/206 |
| 2,868,631 | 1/1959 | Woebcke | 48/206 |
| 3,853,498 | 12/1974 | Bailie | 48/209 |

*Primary Examiner*—S. Leon Bashore
*Assistant Examiner*—Peter F. Ratz
*Attorney, Agent, or Firm*—D. A. Newell; R. H. Davies; R. H. Evans

[57] ABSTRACT

A process is disclosed for contacting at least two solids and a fluid, particularly for retorting and/or gasification of solid carbonaceous materials such as coal, coke, shale or tar sands by introducing a solid heat-transfer material into an upper portion of a treatment or contacting zone and a solid carbonaceous material into a lower portion of the treatment or contacting zone. The solid heat carrier is fluidized by an upflowing gas and moves downwardly, while the solid carbonaceous materials are entrained and move upwardly. The fluidizing gas may be inert or reactive. Substantially countercurrent plug flow of the two solids in the treatment or contacting zone is maintained by including means for preventing back mixing, such as a packing material filling the treatment or contacting zone.

33 Claims, 3 Drawing Figures

COUNTERCURRENT PLUG-LIKE FLOW OF TWO SOLIDS

CROSS-REFERENCE TO RELATED APPLICATIONS

This application is a continuation-in-part of our copending application Ser. No. 670,925, filed Mar. 26, 1976, abandoned, the complete disclosure of which is incorporated herein by specific reference.

BACKGROUND OF THE INVENTION

The present invention relates to the contacting of at least two solids and a fluid wherein one solid is in a fluidized state and the other solid is entrained by a reactive or inert fluidizing medium. In one aspect, the invention relates to the retorting and/or gasification of solid carbonaceous materials such as coal, coke, tar sands, shale, etc.

In view of the recent rapid increases in the price of crude oil, researchers have renewed their efforts to find alternate sources of energy and hydrocarbons. Much research has focused on recovering the hydrocarbons from hydrocarbon-containing solids such as shale, tar sand or coal by heating or pyrolysis to boil off or liquefy the hydrocarbons trapped in the solid or by reacting the solid with steam, for example to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted. The cost of these treatment zones, the accompanying apparatus, and means for transferring reactants and heat into or from these zones plays an important, often dominant part in determining the overall economics of the process. Typically, reaction systems used can be characterized as either fluid bed, entrained bed or moving bed.

Typical of prior art processes using a moving bed is the well-known Lurgi process. Crushed coal is fed into the top of a moving-bed gasification zone and upflowing steam endothermically reacts with the coal. Combustion of a portion of the char with oxygen below the gasification reaction zone supplies the required endothermic heat of reaction. The coal has a long residence time in the gasification reactor of about 1 hour.

A typical entrained-bed process is the well-known Koppers-Totzek process in which coal is dried, finely pulverized and injected into a treatment zone along with steam and oxygen. The coal is rapidly partially combusted, gasified and entrained by the hot gases. Residence time of the coal in the reaction zone is only a few seconds.

Typical of fluid-bed processes is the well-known Union Carbide/Battelle coal gasification process. Crushed and dried coal is injected near the bottom of a treatment zone containing a fluidized bed of coal. Heat for the reaction is provided by hot coal-ash agglomerates which drop through the fluidized bed of coal.

The above-noted processes have many disadvantages. For example, in moving-bed processes the solids residence time is long, necessitating either a very large contacting or reaction zone or a large number of reactors. In entrained-bed processes, the residence time of the solid is short, but very large quantities of hot gases must be utilized to heat the solids rapidly. In fluid-bed processes, the solids flow rate is low compared to entrained-bed processes, because gas rates must be kept low in order to maintain the solid in the fluidized state.

Many of the disadvantages of these prior art processes are avoided or overcome by the process of the present invention, which involves the countercurrent flow of two solids: (1) a fluidized solid heat-transfer material; and (2) an entrained solid carbonaceous material. The process of the present invention is unique in many aspects, particularly in permitting high throughput of solids per unit volume of the treatment or contacting zone employed.

The use of fluidized-bed contacting zones has long been known in the art and has been widely used commercially in the fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the minimum fluidization velocity, and the velocity of the fluid at which the solid becomes entrained in the fluid is known as the terminal velocity. Between the minimum fluidization velocity and the terminal velocity, or entrainment velocity, the bed of solids is in a fluidized state and it exhibits the appearance and some of the characteristics of a boiling liquid.

Fluidized beds have been previously utilized in many conventional contacting processes. Fluidized beds are particularly advantageous where intimate contact between two or more fluidized solids or between solids and gases is desired. Because of the quasi-fluid or liquid-like state of the solids, there is typically a rapid over-all circulation of all the solids throughout the entire bed with substantially complete mixing, as in a stirred-tank reaction system. This rapid circulation is particularly advantageous in conventional processes in which a uniform temperature and reaction mixture is required throughout the contacting zone. On the other hand, a uniform bed temperature and provision of a uniformly mixed bed of solids is a disadvantage when it is desired to maintain a temperature gradient in the contact zone to separate or segregate various types of solids, or to carry out chemical reactions to high conversions.

Gas fluidized beds include a dense particulate phase and a bubble phase, with bubbles forming at or near the bottom of the bed. These bubbles generally grow by coalescence as they rise through the bed. Mixing and mass transfer are enhanced when the bubbles are small and evenly distributed throughout the bed. When too many bubbles coalesce so that large bubbles are formed, a surging or pounding action results, leading to less efficient heat and mass transfer.

The problem of surging or slugging in fluidized beds is not fully understood. An article by D. Geldart, Powder Technology, 7 (1973), 285–292, discusses various characteristics of fluidized beds and indicates that the phenomenon of slugging is influenced by the density of the fluidization gas, the density of the particles and the mean particle size.

Various solutions have been proposed for controlling slugging in fluidized beds. The use of baffles and other internal structural members or obstacles has been suggested, as for example in U.S. Pat. No. 2,533,026. Internal devices, however, impede over-all, substantially complete mixing of solids, which is desired in most conventional fluidized-bed processes.

U.S. Pat. No. 2,376,564 discloses a process in which a fluidized catalyst is used to catalytically crack an upflowing gaseous hydrocarbon. This patent furthermore discloses the use of a non-fluidized, heat-transfer material such as balls or pellets.

U.S. Pat. No. 3,927,996 discloses a process in which pulverized coal is carried through a portion of a bed of fluidized char. The fluidized char is introduced into a lower portion of the gasifier and reacts with steam to produce a synthesis gas.

U.S. Pat. No. 2,557,680 discloses a fluidized-bed carbonization process including a reaction zone and a regeneration zone. The reactor may contain packing material.

U.S. Pat. No. 2,700,592 discloses a fluidized-bed process for desulfurizing sulfide ores.

U.S. Pat. No. 2,868,631 discloses a fluidized bed process for gasifying coal which employs a reactor containing packing material.

U.S. Pat. No. 3,853,498 discloses a fluidized-bed process in which sand is employed for heating municipal waste.

SUMMARY OF THE INVENTION

In one embodiment, the present invention relates to a process for gasifying a solid carbonaceous material in a gasification zone, the gasification zone including means for substantially impeding vertical back mixing of vertically moving solids substantially throughout the gasification zone, which comprises:

(1) introducing into an upper portion of the gasification zone a first particulate solid comprising a solid heat-transfer material;

(2) introducing into a lower portion of the gasification zone a second particulate solid comprising a solid carbonaceous material, the physical characteristics of the first solid and second solid differing such that a superficial velocity of a fluid flowing upwardly through the gasification zone is greater than the minimum fluidizing velocity of the first solid and less than the terminal velocity of the first solid while the superficial velocity is greater than the terminal velocity of the second solid;

(3) maintaining substantially countercurrent vertical flow of the first and second solids in the gasification zone without substantial top-to-bottom back mixing of the first and second solids in the gasification zone by passing a reactive gas stream including a reactive component upwardly through the gasification zone at a rate sufficient to fluidize the first solid and entrain the second solid, and forming a fluid product and an at least partially gasified solid carbonaceous material by reacting the second solid with the reactive component, whereby the first solid substantially flows downwardly through the gasification zone and the second solid substantially flows upwardly through the gasification zone, and the first and second solids pass through the gasification zone in countercurrent plug flow;

(4) removing from a lower end of the gasification zone the heat-transfer material at a temperature substantially different from the temperature at which the heat-transfer material was introduced into the gasification zone; and (5) removing from an upper end of the gasification zone the product fluid and the at least partially gasified solid.

In a preferred operation according to the foregoing embodiment, the reactive gaseous fluid comprises steam, the solid carbonaceous material is coal, the coal is partially gasified in the gasification zone, producing a hot char and a cooled heat-transfer material, and the cooled heat-transfer material is heated to an elevated temperature by:

(1) introducing at least a portion of the cooled heat-transfer material into an upper portion of a combustion zone, the combustion zone including means for substantially impeding vertical back mixing of vertically moving solids substantially throughout the combustion zone;

(2) introducing at least a portion of the hot char into a lower portion of the combustion zone;

(3) heating the cooled heat-transfer material to an elevated temperature by contacting the hot char with the heat-transfer material in the combustion zone, maintaining substantially countercurrent plug flow of the heat-transfer material and the char in the combustion zone by passing an oxygen-containing fluidization and combustion gas upwardly through the combustion zone at a rate sufficient to fluidize the heat-transfer material and entrain the char, whereby the heat-transfer material substantially flows downwardly through the combustion zone and is heated to an elevated temperature while the char substantially flows upwardly through the combustion zone and is combusted.

In another embodiment, the present invention relates to a process for retorting a solid carbonaceous material in a retorting zone, the retorting zone including means for substantially impeding vertical back mixing of vertically moving solids substantially throughout the retorting zone, which comprises:

(1) introducing at an elevated temperature into an upper portion of the retorting zone a first solid comprising a solid heat-transfer material;

(2) introducing into a lower portion of the retorting zone a second solid comprising a solid carbonaceous material, the physical characteristics of the first and second solids differing such that a superficial velocity of a fluid flowing upwardly through the retorting zone is greater than the minimum fluidizing velocity of the first solid in the fluid and less than the terminal velocity of the first solid in the fluid while the superficial velocity is greater than the terminal velocity of the second solid;

(3) maintaining substantially countercurrent vertical flow of the first and second solids in the retorting zone without substantial top-to-bottom back mixing of solids in the retorting zone by passing a gaseous stream upwardly through the retorting zone at a rate sufficient to fluidize the first solid and entrain the second solid, whereby the first solid substantially flows downwardly through the retorting zone in plug flow and is cooled by contact with the gaseous stream while the second solid substantially flows upwardly through the retorting zone in plug flow countercurrent to the first solid and is heated sufficiently to form an at least partially retorted solid and a fluid product;

(4) removing from a lower end of the retorting zone a cooled heat-transfer material;

(5) removing from an upper end of the retorting zone the fluid product and the at least partially retorted solid.

In a preferred operation according to the foregoing embodiment, the cooled heat-transfer material is heated to an elevated temperature by:

(1) introducing at least a portion of the cooled heat-transfer material into an upper portion of a combustion zone, the combustion zone including means for substantially impeding vertical back mixing of vertically flowing solids;

(2) introducing at least a portion of the retorted shale into a lower portion of the combustion zone;

(3) maintaining substantially countercurrent plug flow of the heat-transfer material and the partially retorted shale in the combustion zone by passing an oxygen-containing fluidization and combustion gas upwardly through the combustion zone at a rate sufficient to entrain the partially retorted shale and fluidize the heat-transfer material, whereby the heat-transfer material substantially flows downwardly through the combustion zone and is heated to an elevated temperature while the partially retorted shale substantially flows upwardly through the combustion zone and is combusted.

In another embodiment, the present invention relates to a method for contacting two solids in a contacting zone, the contacting zone including means for substantially impeding vertical back mixing of vertically flowing solids substantially throughout the contacting zone, which comprises:

(1) introducing into an upper portion of the zone a first solid;

(2) introducing into a lower portion of the zone a second solid, the physical characteristics of the first and second solids differing such that the superficial velocity of a fluid flowing upwardly through the zone is greater than the minimum fluidizing velocity and less than the terminal velocity of the first solid in the fluid while the superficial velocity of the fluid is greater than the terminal velocity of the second solid;

(3) maintaining substantially countercurrent vertical flow of the first and second solids in the zone without substantial top-to-bottom mixing of solids in the zone by passing the fluid stream upwardly through the zone at a rate sufficient to fluidize the first solid and entrain the second solid, whereby the first solid substantially flows downwardly through the zone in plug flow while the second solid substantially flows upwardly through the zone in plug flow and contacts the first solid;

(4) removing from a lower end of the zone the first solid; and (5) removing from an upper end of the zone the fluid stream and the second solid.

In a particularly preferred operation in accordance with the foregoing embodiment, the means for impeding back mixing includes packing material and the contacting zone is substantially filled with the packing material.

In a further embodiment, the present invention relates to a process for the gasification of a solid carbonaceous material in a gasification vessel substantially completely filled with a packing material, which comprises (1) introducing into an upper portion of a gasification vessel a first solid comprising a solid heat-transfer material;

(2) introducing into a lower portion of the gasification vessel a second solid comprising a solid carbonaceous material wherein the physical characteristics of the first and second solid differ such that the superficial velocity of a fluid flowing through the vessel is greater than the minimum fluidizing velocity of the first solid in the fluid and less than the terminal velocity of the first solid in the fluid while the superficial velocity of the fluid is greater than the terminal velocity of the second solid in the fluid;

(3) maintaining substantially countercurrent plug flow of the first and second solids in the vessel by passing a reactive gaseous fluid upwardly through the vessel at a rate sufficient to fluidize the first solid and entrain the second solid whereby the first solid substantially flows downwardly through the vessel while the second solid substantially flows upwardly through the vessel and reacts with the reactive gaseous fluid forming a fluid product and an at least partially gasified solid carbonaceous material;

(4) removing from a lower portion of the vessel the heat-transfer material at a temperature substantially different than the temperature at which the heat-transfer material was introduced into the vessel; and (5) removing from an upper portion of the vessel the product fluid and the at least partially gasified solid.

In a preferred operation according to the foregoing embodiment, the reactive gaseous fluid comprises steam and the solid carbonaceous material is coal, and the coal is partially gasified in the gasification vessel producing a hot char, and a cooled heat transfer material, and the cooled heat-transfer material is heated to an elevated temperature by:

(1) introducing at least a portion of the cooled heat-transfer material into an upper portion of a combustion vessel substantially completely filled with a packing material;

(2) introducing at least a portion of the hot char into a lower portion of the combustion vessel;

(3) heating the cooled heat-transfer material to an elevated temperature by contacting the hot char with the heat-transfer material and combustion gases by maintaining substantially countercurrent plug flow of the heat-transfer material and the char by passing an oxygen-containing fluidization and combustion gas upwardly through the combustion vessel at a rate sufficient to fluidize the heat-transfer material and entrain the char whereby the heat-transfer material substantially flows downwardly through the combustion vessel and is heated to an elevated temperature while the char substantially flows upwardly through the combustion vessel and is combusted.

In another embodiment, the present invention relates to a process for retorting a solid carbonaceous material in a retorting vessel substantially completely filled with a packing material, which comprises:

(1) introducing at an elevated temperature into an upper portion of the retorting vessel a first solid comprising a solid heat-transfer material;

(2) introducing into a lower portion of the retorting vessel a second solid comprising a solid carbonaceous material wherein the physical characteristics of the first and second solids differ such that the superficial velocity of a fluid flowing through the vessel is greater than the minimum fluidizing velocity of the first solid in the fluid and less than the terminal velocity of the first solid in the fluid while the superficial velocity of the fluid is greater than the terminal velocity of the second solid;

(3) maintaining substantially countercurrent plug flow of the first and second solids in the vessel by passing a gaseous fluid upwardly through the vessel at a rate sufficient to fluidize the first solid and entrain the second solid whereby the first solid substantially flows downwardly through the vessel and is cooled by contact with the gaseous fluid while the second solid substantially flows upwardly through the vessel and is heated, producing an at least partially retorted solid and a fluid product;

(4) removing from a lower portion of the vessel a cooled heat-transfer material;

(5) removing from an upper portion of the vessel the fluid product and an at least partially retorted solid.

In a preferred operation according to the foregoing embodiment, the solid carbonaceous material is shale and the partially retorted solid comprises retorted shale containing carbon, at least a portion of the heat necessary to heat the cooled heat-transfer material to an elevated temperature is provided by combusting the carbon-containing retorted shale with an oxygen-containing gas, and the cooled heat-transfer solid material is heated to an elevated temperature by:

(1) introducing at least a portion of the cooled heat-transfer solid into an upper portion of a combustion vessel substantially completely filled with a packing material;

(2) introducing at least a portion of the retorted shale into a lower portion of the combustion vessel;

(3) maintaining substantially countercurrent plug flow of the heat-transfer material and the partially retorted shale in the combustion vessel by passing an oxygen-containing fluidization and combustion gas upwardly through the combustion vessel at a rate sufficient to entrain the partially retorted shale and fluidize the heat-transfer material whereby the heat-transfer material substantially flows downwardly through the combustion vessel and is heated to an elevated temperature while the partially retorted shale substantially flows upwardly through the combustion vessel and is combusted.

In a further embodiment, the present invention relates to a process for contacting two solids in a vessel substantially completely filled with a packing material, which comprises:

(1) introducing into an upper portion of the vessel a first solid;

(2) introducing into a lower portion of the vessel a second solid wherein the physical characteristics of the first and second solids differ such that the superficial velocity of a fluid flowing through the vessel is greater than the minimum fluidizing velocity of the first solid in the fluid and less than the terminal velocity of the first solid in the fluid while the superficial velocity of the fluid is greater than the terminal velocity of the second solid;

(3) maintaining substantially countercurrent plug flow of the first and second solids in the vessel by passing the fluid upwardly through the vessel at a rate sufficient to fluidize the first solid and entrain the second solid whereby the first solid substantially flows downwardly through the vessel while the second solid substantially flows upwardly through the vessel and contacts the first solid;

(4) removing from a lower portion of the vessel the first solid; and (5) removing from an upper portion of the vessel the fluid and the second solid.

A preferred packing material for use in suitable embodiments of the invention is pall rings.

DETAILED DESCRIPTION OF THE INVENTION AND PREFERRED EMBODIMENTS

Figure 1:
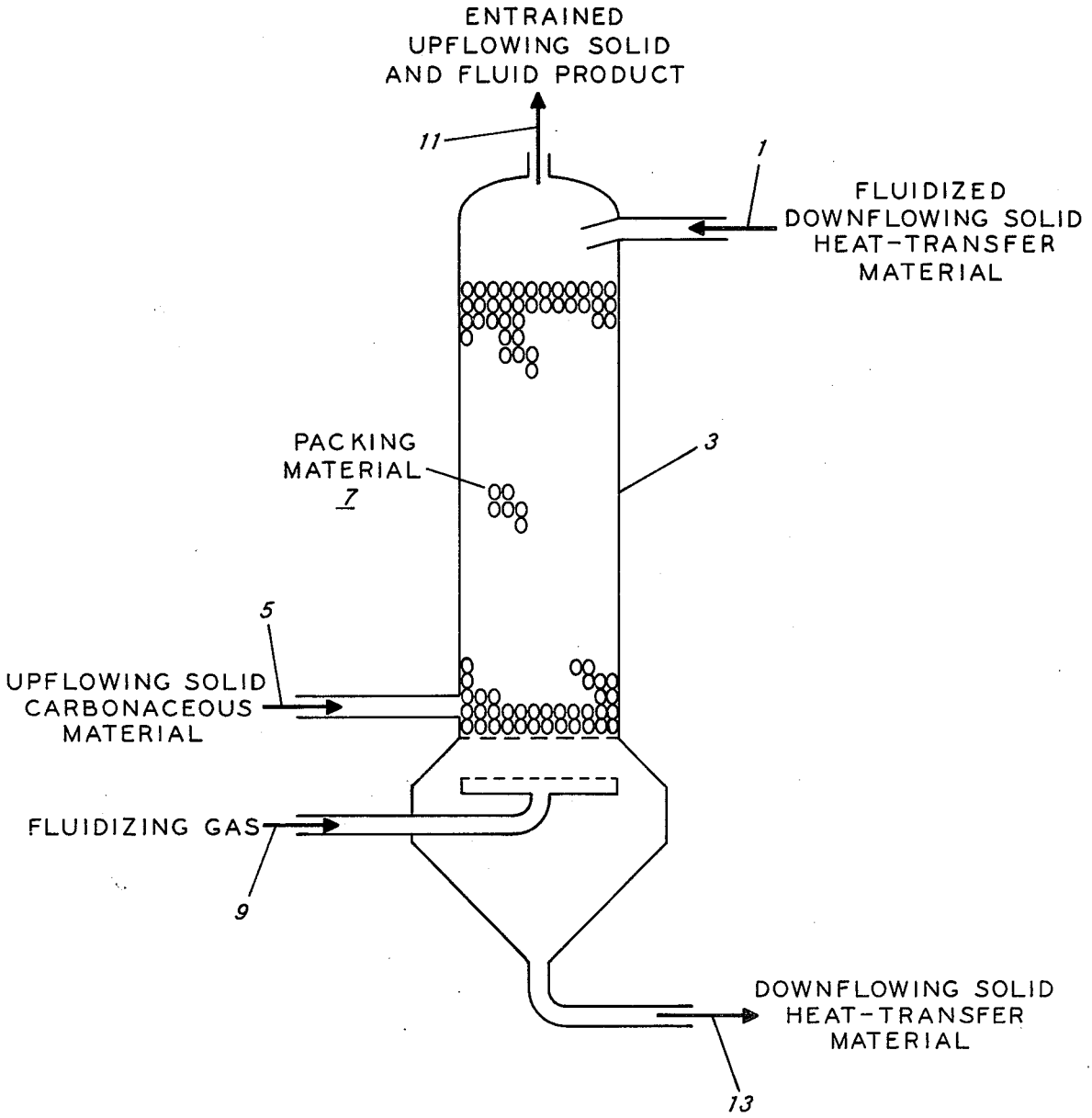
FIG. 1 is a diagrammatic illustration of one preferred configuration of a fluidization system for use according to the invention.

Some aspects of the process of the invention may best be described by reference to FIG. 1.

One embodiment of the invention broadly comprises feeding into the upper end of a vessel 3 via line 1 a solid heat-transfer material which passes into the upper portion of a contacting or treatment zone in the vessel 3 wherein the solid is maintained in a fluidized state by an upflowing stream of fluidization gas introduced via line 9.

The contacting or treatment zone, e.g., a retorting or endothermic or exothermic gasification zone, used in the present process may be defined by any conventional vessel, shell reactor, etc., which is capable of containing the solids, liquids and gases employed and generated in the process at the pressures and temperatures used. Often, a retorting or gasification vessel includes conventional disengaging zones at the top end, bottom end (or both) of the contacting zone to permit a desired disengagement of solids from fluids. The use of various vessels, reactors, shells, etc., with or without a disengaging zone at either the top or bottom end thereof to provide a contacting zone for use according to the present invention is within the ability of those skilled in the art from the description provided herein.

A suitably comminuted solid carbonaceous material is fed into a lower portion of the contacting zone at the lower end of the vessel 3 via line 5 and is entrained by the upflowing fluidization gas stream. The heat-transfer material substantially flows downwardly through the treatment zone while the solid carbonaceous material flows upwardly. The flow of the two solids is substantially countercurrent. The flow of each of the two solids is plug-like in nature and occurs without substantial top-to-bottom mixing because of the inclusion in the vessel of means for substantially impeding back mixing, such as a bed of packing material 7, which fills the contacting zone in the vessel 3. The upflowing carbonaceous solids are intimately contacted with the fluidizing gas stream and the downflowing heat-transfer material within the packing material-filled contacting zone. Upflowing solids and a fluid product exit the upper portion of the contacting zone and are withdrawn from the upper end of vessel 3 via line 11 while the downflowing solid heat-transfer material exits the lower portion of the contacting zone and is withdrawn from the lower end of the vessel 3 via line 13.

The heat-transfer material can be utilized to transfer heat either into or out of vessel 3, depending on whether it is desired to carry out an exothermic process or an endothermic process. In general, the temperature at which the heat-transfer material is introduced is substantially different from the temperature at which it is removed, i.e., at least 100° F. difference and preferably from 500° to 2000° F. difference.

If it is desired to carry out retorting, heat-transfer material is introduced at an elevated temperature relative to the introduction temperature of the carbonaceous solid material. As the solid carbonaceous material flows upwardly, it is heated by contact with the upflowing fluid and the downflowing heat-transfer material. As the upflowing solids are heated, the more volatile constituents of the carbonaceous solid vaporize and/or liquefy, forming a fluid product which is entrained in the upflowing stream of gases and solids. In carrying out retorting, it is preferable that the composition of the fluidizing gas is such that it is essentially inert relative to the solid carbonaceous material. The inert fluidizing gas may comprise, for example, recycle product gas from the retort. Cooled heat-transfer material is withdrawn from a lower portion of the retorting vessel 3 via line 13.

If it is desired to carry out an endothermic reaction, such as the gasification reaction of coal with steam, then the heat-transfer material is introduced at an elevated temperature relative to the introduction temperature of the carbonaceous solid. A stream of a fluidizing gas including a reactive component such as steam is introduced via line 9. The steam and solid carbonaceous material react as the two flow upwardly through the reaction zone filled with packing material, forming a fluid product gas, while the downflowing heat-transfer material provides at least the major portion of the endothermic heat needed for the gasification reaction.

The process of the invention can also be used for carrying out an exothermic reaction such as the combustion of coal. In an embodiment wherein an exothermic reaction is carried out, cold heat-transfer material is introduced via line 1 and a stream of a fluidizing gas containing an exothermically reactive component such as oxygen is introduced via line 9. As the reactive component in the gas stream exothermically reacts with the upflowing solid carbonaceous material, the downflowing heat-transfer material absorbs the heat of reaction and the heat-transfer material is removed via line 13 at a substantially higher temperature than its introduction temperature.

The term "gasification" is used in the present invention to mean any endothermic or exothermic reaction between the solid carbonaceous material and at least one reactive component of the fluidizing gas. The term "retorting" is used in the present invention to mean a process wherein a solid carbonaceous material is heated to liberate or drive out volatile or liquefiable hydrocarbons. As is apparent to any person skilled in the art, retorting and gasification can occur consecutively or concurrently. Furthermore, it is apparent that any hydrocarbons once formed or liberated in the retort or gasification vessel can undergo further reactions in the vessel.

Other suitable fluidizing gases, in addition to steam and oxygen, include air, CO, $CO_2$, $H_2$, methane, ethane and other light hydrocarbons, recycled product gas and mixtures of the above. The type of fluidizing gas chosen for a particular application of the present process will, of course, depend primarily on the reactions to be promoted, and the choice of a suitable fluidizing gas will be within the ability of those skilled in the art. Whether the gas chosen is reactive or inert will, of course, depend partly upon the type of solid carbonaceous material and will particularly depend on the other reaction conditions maintained in the vessel including temperature, pressure and residence time. It is apparent that the composition of the fluidizing gas stream will change as the gas stream flows upwardly through the contacting zone, and when withdrawn will include product gas and/or a vaporized portion of the solid feed material.

Choice of appropriately classified solids is a critical feature of the present invention. The physical characteristics of the downflowing solid must differ from those of the upflowing solid such that the downflowing solid is not entrained by the fluidizing gas. The physical characteristics of the downflowing solid must differ from the physical characteristics of the upflowing solid such that the superficial velocity of the fluidizing gas stream flowing through the contacting zone is greater than the minimum fluidizing velocity of the downflowing solid and less than the terminal velocity of the downflowing solid, while at the same time superficial velocity of the fluidizing gas stream is greater than the terminal velocity of the upflowing solid. In general, a solid's most important physical characteristics are size, shape and density.

If one considers only size, shape, and density, and assumes no interparticle forces such as electrostatic forces or Van der Waals' forces, then the downflowing solid must, in general, differ in size, shape or density from the upflowing solid such that the net force exerted on the downflowing solid is greater than the net force exerted on the upflowing solid. By "net force" it is meant the sum of the gravitational force exerted on the solid, plus the drag force exerted on the solid by the upflowing fluidization gases, plus the buoyancy force exerted on the solid by said fluidization gas. Preferably, the physical characteristics of the two solids are substantially different, so that the velocity of the upflowing stream of gases can be varied over a wide range while the downflowing solid remains in a fluidized state and the upflowing solid is entrained.

As mentioned above, other forces, such as van der Waal's forces, electrostatic forces, surface tension, etc., may also influence whether two different solids can simultaneously exist in a fluidized and entrained state. The physical characteristics and compatability of any two particular solids for use in the present process can always readily be determined on an experimental basis by any person skilled in the art.

The downflowing particulate solid heat-transfer materials can be reactive, inert, or comprise a mixture or composite of reactive and inert materials. Preferably, however, the downflowing solid is inert and preferably in the form of granules, balls or pellets.

A particularly preferred heat-transfer material is sand.

The upflowing particulate solid carbonaceous material can comprise coal, coke, lignite, shale, tar sands, sawdust, municipal, industrial or agricultural waste products, etc., or mixtures thereof.

Catalysts can also be mixed with or comprise part of the upflowing or downflowing solid. Particularly preferred catalysts are those particulate catalysts which are well known in the hydrocarbon processing industry, for example, catalytic cracking catalysts.

As discussed above, the heat-transfer material and the solid carbonaceous solid need only differ in physical characteristics such that substantially all of the heat-transfer material remains in a fluidized state while substantially all the upflowing solid is entrained in the stream of fluidization gas.

An essential feature of the present invention is that the treatment or contacting zone, e.g., a vessel, include means for substantially impeding back mixing of both the upflowing solid and the downflowing solid. The means for impeding back mixing must substantially impede back mixing throughout substantially the whole contacting zone. The object of including means for impeding back mixing in the contacting zone is to maintain essentially plug flow of both the upwardly moving solid and downwardly moving solid. Suitable means for impeding back mixing, i.e., means for providing essentially countercurrent plug flow of the solids, include packing materials, i.e., fixed beds of subdivided materials not attached to the wall of a vessel, reactor or shell defining the contact zone. Suitable means for impeding back mixing to provide essentially plug flow of the solids also include internal apparatus fixed to the wall of a vessel, reactor or shell defining the contact zone.

Maintaining continuous countercurrent plug flow substantially throughout the contacting zone has many advantages, including:

(1) Plug flow, wherein there is little or no gross back mixing of either solid in the treatment zone, provides much higher conversion levels of carbonaceous material in a smaller contacting zone volume than can be obtained in fluidized-bed reactors with gross top-to-bottom mixing, even when the fluidized-bed reactors are divided into 2 to 5 distinct fluid bed zones. In conventional unpacked fluidized beds or in stirred-tank reactors, the product stream removed from the conventional contacting zone approximates the average conditions in the conventional contacting zone. Thus, in such processes, unreacted or partially reacted material is necessarily removed with the product stream, leading to costly separation and recycle of unreacted materials. Maintaining plug flow and preventing top-to-bottom mixing of either solid, on the other hand, allows one to operate the process of the present invention on a continuous basis with the residence time being precisely variable to control the degree of vaporization or reaction. Thus, if desired, one can obtain essentially complete reaction or retorting of a solid carbonaceous material in a single pass of the solid through the treatment zone, and many of the expensive separation and recycle operations of prior art processes can be avoided.

(2) The effect of countercurrent plug flow of two solids also has a significant advantage with regard to controlling and optimizing the heat-transfer and reaction temperatures in the treatment zone. For example, with the hot heat-carrying material entering the top of the contacting or treatment zone and the relatively cold carbonaceous material entering the bottom of the treatment zone or chamber, highly desirable thermal gradient is obtainable with the maximum and minimum temperatures at opposite ends of the contacting zone. As is well known to those in the heat-transfer art, countercurrent flow normally provides the most efficient means of heat transfer.

Thus, for example, in the retorting of shale, shale is introduced in the bottom of the retort where it contacts the downflowing fluid bed of sand. Because the flow of solids in the retorting treatment zone is countercurrent, without top-to-bottom back mixing of either solid, to provide plug-type flow of both solids the spent shale contacts the hottest sand last and cold shale entering the retorting zone contacts the cold heat-transfer material first. Thus, a large, controllable thermal gradient may be maintained, allowing the degree of retorting to be controlled. Provision of the thermal gradient also reduces readsorption of shale oil into the spent shale. If desired, hot, partially spent shale and the cool sand can then be introduced into a countercurrent flow combustion-type gasification zone. The design and operation of the combustor are similar to those of the retort, except that the combustion zone is fluidized with air or other oxygen-containing gas to burn off the fixed carbon from the shale and transfer heat to the sand. The shale is entrained upwardly through the downwardly flowing bed of sand and passes out of the combustion gasification zone past the incoming cold sand, having transferred its heat to the sand. Spent shale thus leaves the combined retorting and combustion system at the lowest temperature in the system. Such a combined system provides an extremely thermally efficient process, in that cold fresh shale enters the process and relatively cold spent shale leaves the process.

(3) Plug flow, without top-to-bottom solids back mixing, also permits a substantial reduction in the size of the reaction zone required, since the need for a large disengaging zone (as is normally required in unpacked fluidized beds) is eliminated. In many systems with fluid beds in which back mixing is not prevented, a large portion of the volume of the vessel, frequently from 50% to 80%, is conventionally used as a disengaging zone. Bubbles formed in the fluid bed burst at the top of the bed, spouting upwardly a large amount of material. A large disengaging zone is necessary in such conventional systems to allow this material to drop back into the fluid portion of the bed and avoid carryover of the solids out of the vessel along with the fluidized gas. Since coalescence of large bubbles is prevented in the present invention, this bursting is essentially eliminated, allowing the size of the disengaging zone to be substantially reduced.

Plug flow of both of the solids in the treatment zone is obtained by providing the reaction zone with means for impeding back mixing, such as packing material. By "substantially plug flow" it is meant that there is no top-to-bottom mixing and only localized back mixing of the solids as they flow through the vessel. As the degree of top-to-bottom back mixing increases in the contacting zone, the efficiency of the present process decreases. Therefore, gross back mixing (top-to-bottom back mixing in the contacting zone) must be avoided in the present process throughout the contacting zone.

While gross back mixing must be avoided, highly localized mixing is desirable in that it increases the degree of contacting between the solids and gases. The degree of back mixing is, of course, dependent on many factors, particularly the bed depth and the means employed for impeding back mixing. When packing material is used, localized back mixing will be substantially confined to within 2 to 4 layers of packing material. In order to impede back mixing throughout substantially the whole contacting zone, packing material is used in an amount sufficient to fill or substantially fill the contacting zone, except for any disengaging space at the top or bottom of a vessel defining the contacting zone.

Packing materials are the preferred means for impeding back mixing in carrying out the process of the invention. Numerous packing materials known to those skilled in the art include spheres, cylinders and other specially shaped items, etc. Any of these numerous packing materials may produce the desired effect in causing the gross vertical flow of solids to be substantially plug-like in nature while causing highly localized mixing. A particularly preferred packing material which is well known to those skilled in the art is pall rings. Pall rings are, in general, cylindrical in shape with a portion of the wall of the cylinder being projected inwardly, which promotes localized circulation of the solids and gases and which prevents the problem of some solid-wall-type packings in permitting channeling to occur or gravitation of solids or gases toward the reactor wall. Pall rings are commercially available in many sizes, including sizes from less than 1 inch in diameter to more than 3 inches in diameter. The choice of size will, of course, depend upon many other factors, such as the bed depth and vessel diameter. These design features and others are, of course, readily determined by any person skilled in the art.

The means employed for impeding back mixing may also be "fixed"-type internals. Examples of suitable internals which are typically fixed to the wall of a vessel, shell, reactor, or the like, wholly or partly defining the contacting zone are horizontal tubes and/or rods, vertical tubes and/or rods, combinations of horizontal tubes and/or rods and vertical tubes and/or rods, slats, screens and grids with and without downcomers, perforated plates with and without downcomers, bubbles caps with and without downcomers, Turbogrid trays, Kittle plates, corrugated baffles, combinations of horizontal grids and wire spacers, combinations of two or more of the above-listed apparatus, and like internals used by those skilled in the art, conventionally fixed to the wall of vessels for impeding flow therein. Thus, although packing materials such as pall rings are particularly preferred means for impeding back mixing in the contacting zone, the above-described internals typically fixed to the wall of a vessel can also be used, either as a substitute for the packing or in combination with the packing material. In order to impede back mixing substantially throughout the contacting zone, internals fixed to the wall of a vessel defining the contacting zone must be positioned substantially throughout the contacting zone. That is, the internals are used to provide the same effect as would be obtained by substantially filling the contacting zone with a packing material, such as pall rings. The primary object of using either packing material or other internals fixed to a reactor or vessel wall is, of course, to provide plug-type flow of both the upflowing solid and the downflowing solid throughout substantially the whole contacting zone.

A further advantage of employing means in the contacting zone for impeding back mixing and a critical aspect of the invention with some types of fluidized material is the prevention of slugging in the fluidized bed. In many fluidized beds, the bubbles of fluidized solids tend to coalesce much as they do in a boiling liquid. When too many bubbles coalesce, surging or pounding in the bed results, leading to a loss of efficiency in contacting. Extensive slugging occurs when enough bubbles coalesce to form a single bubble which occupies the entire cross section of the vessel. This bubble then proceeds up the vessel as a slug. The rate and nature of the coalescence of these bubbles is not fully understood to those skilled in the art but apparently depends on many factors, particularly the height and diameter of the bed and the particles density and the size. One study by Geldart, *Powder Technology*, 7 (1963) 282–292, the entire disclosure of which is incorporated herein by reference, characterizes various types of particles and their tendency for slugging. Geldart characterizes particles as being either type A, B or C.

Type B particles are characterized in that naturally occurring bubbles start to form at only slightly above the minimum fluidization velocity. Type B particles are also characterized in that there is no evidence of a maximum bubble size and coalesce is the predominant problem. Sand is a type B solid.

Thus, in the present invention, when sand (the preferred fluidized solid heat-transfer material) is used, it is critical to maintaining countercurrent plug flow that bubble coalescence be minimized by the inclusion of means for impeding top-to-bottom solids mixing in the treatment zone, e.g., packing material. Pall rings is the preferred type of packing material when a type B solid is being fluidized, and particularly when sand is fluidized.

Still another important advantage of the use of means for preventing top-to-bottom mixing, e.g., packing material, in combination with the downflowing solid is that the volume of the treatment zone can be substantially reduced in size relative to prior art entrained-bed processes, because the combination of the packing material, or other means for impeding top-to-bottom mixing, and the downflowing solid substantially increases the hold-up time of the upwardly flowing entrained solid. In prior art processes involving entrained-bed flow, the residence time of the solid per linear foot of reactor is generally very low. This necessitates either: (1) grinding the reactant solid to a very small size so that it reacts relatively rapidly; (2) building relatively tall, expensive reactors to increase the total residence time of the solid; or (3) operating the reactor at a very high temperature in order to obtain a very fast reaction.

In the process of the present invention, flow of the entrained solid carbonaceous material is substantially impeded by the means employed for impeding top-to-bottom mixing, e.g., packing material. In most cases, depending upon the choice of particular means for impeding gross mixing throughout the contacting zone and other factors, the solids hold-up time of the entrained solid is at least $1\frac{1}{2}$ to 3 times greater than with prior art processes, such as the Koppers-Totzek process. This aspect of the invention is particularly important, because in many gasification or retorting processes the gasification and retorting vessels frequently represent 10% and 50% of the capital cost of the process. By doubling the solids hold-up, the number of reactors needed can essentially be cut in half.

Figure 2:
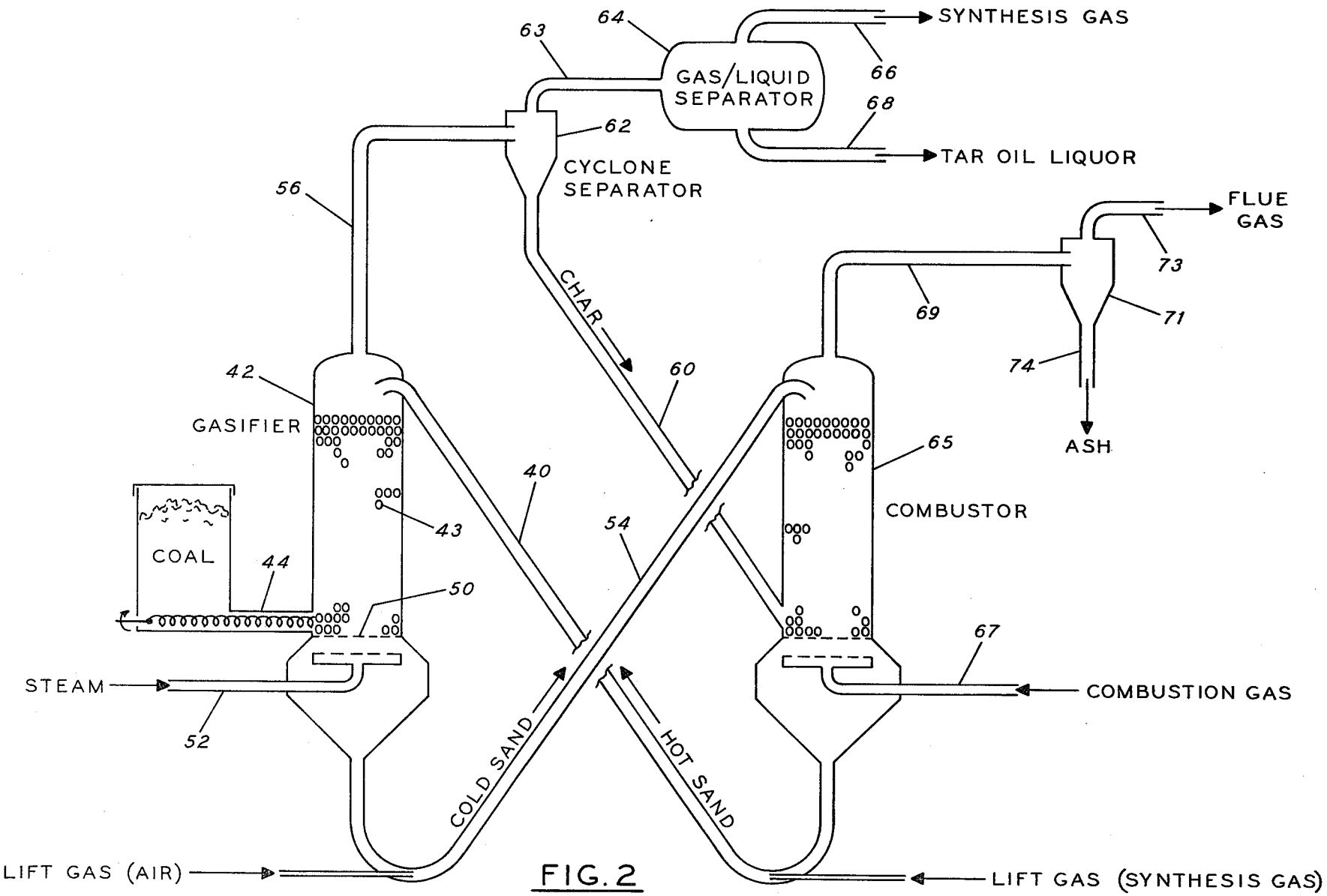
FIG. 2 is a schematic process flow diagram illustrating a preferred embodiment of the invention as it applies to the gasification of coal.

Various other embodiments and modifications of the invention are apparent from FIG. 2, which illustrates a preferred embodiment of the invention for use in gasification of a solid carbonaceous material such as coal.

In FIG. 2, hot sand heat-transfer material is fed via line 40 into an upper portion of a gasification vessel 42, while coal is fed into a lower portion of the vessel via line 44 by any appropriate means, for example by a screw feeder. The coal used has been crushed and sized by conventional means (not shown) such that the difference in physical characteristics, particularly shape, size and density between the coal and the sand is such that the coal is capable of being substantially entrained in the fluidization gas stream while the heat-transfer material, sand, is fluidized.

The gasification zone in the vessel 42 is filled with a suitable means for impeding solids mixing, such as packing material 43, preferably pall rings. The bed of stationary packing material shown in FIG. 2 is supported by grid or distributor 50 or other suitable support means. Steam or product synthesis gas is fed to the gasifier 42 via line 52 at a rate sufficient to fluidize the downflowing sand and entrain the coal. The downflowing sand loses heat as it flows downwardly in the vessel and cold sand is removed from the vessel through line 54 and transferred to a combustion zone in a vessel 65. The coal endothermically reacts with the steam as it passes upwardly through the gasification zone in the vessel 42. The residence time of the coal and the temperature of the gasification reaction zone and other variables can readily be adjusted by one skilled in the art to vary the degree of reaction. Ash, char, product gas, light hydrocarbons having from 1 to 4 hydrocarbons and higher-molecular-weight hydrocarbons, etc., are removed from the gasification reaction zone via line 56. Preferably a cyclone separator 62 or other suitable means for separating solids from fluids is provided to separate the solids from the gaseous and liquid products. Separated char is preferably fed to combustor 65 via line 60 and separated gas and any liquid are fed via line 63 to a conventional gas-liquid separator 64, wherein the product is separated into a condensable fraction, which is removed via line 68, and a light hydrocarbon and synthesis gas fraction, which is removed via line 66.

The cold sand can be reheated for recycle to the gasifier in any suitable manner, but it is preferred to use the process of the present invention to reheat the cold sand using heat generated by burning char produced in the gasifier 42. Hot char is fed into a lower portion of combustion vessel 65 and cold sand is introduced into an upper portion of the combustor via line 54. Air or some other gas may be used as a lift gas to convey the cold sand from the bottom of gasifier 42 to the top of combustor 65. A combustion gas stream containing a reactive component such as molecular oxygen is introduced into a lower portion of the combustion vessel via line 67 at a rate sufficient to fluidize the sand and entrain the char. Combustor 65 includes means for impeding top-to-bottom mixing of solids in the combustion zone therein, such as a packing material filling the combustion zone. The char is combusted as it flows upwardly, heating the sand as it flows downwardly. The hot sand is then conveyed by any suitable means, for example by the use of a portion of product gas from line 66, to the top of the gasifier 42 via line 40. Flue gas and ash are removed from the combustor via line 69 and are separated, for example in a cyclone separator 71, into a flue gas passed into line 73 and ash passed into line 74. The energy in the hot flue gas can be recovered and used for power generation or steam generation. If desired, combustor 65 may contain internal heat-exchange coils for generating steam for any use, but particularly for injection into gasifier 42. One particular advantage of this combination of a fluidized endothermic gasification operation combined with a fluidized exothermic gasification operation is the high over-all thermal efficiency of the process.

Another advantage and one preferred embodiment of the present invention involves feeding coal, associated with liquid water, e.g., a coal-water slurry, into the gasification zone. In this case, a relatively inert gas, such as product gas, can be used to fluidize the coal, with steam being formed from the water as the coal flows upwardly through the gasifier. This embodiment of the invention is particularly advantageous in contrast to the many prior art processes teaching that coal must be dried prior to being fed into a gasifier.

Figure 3:
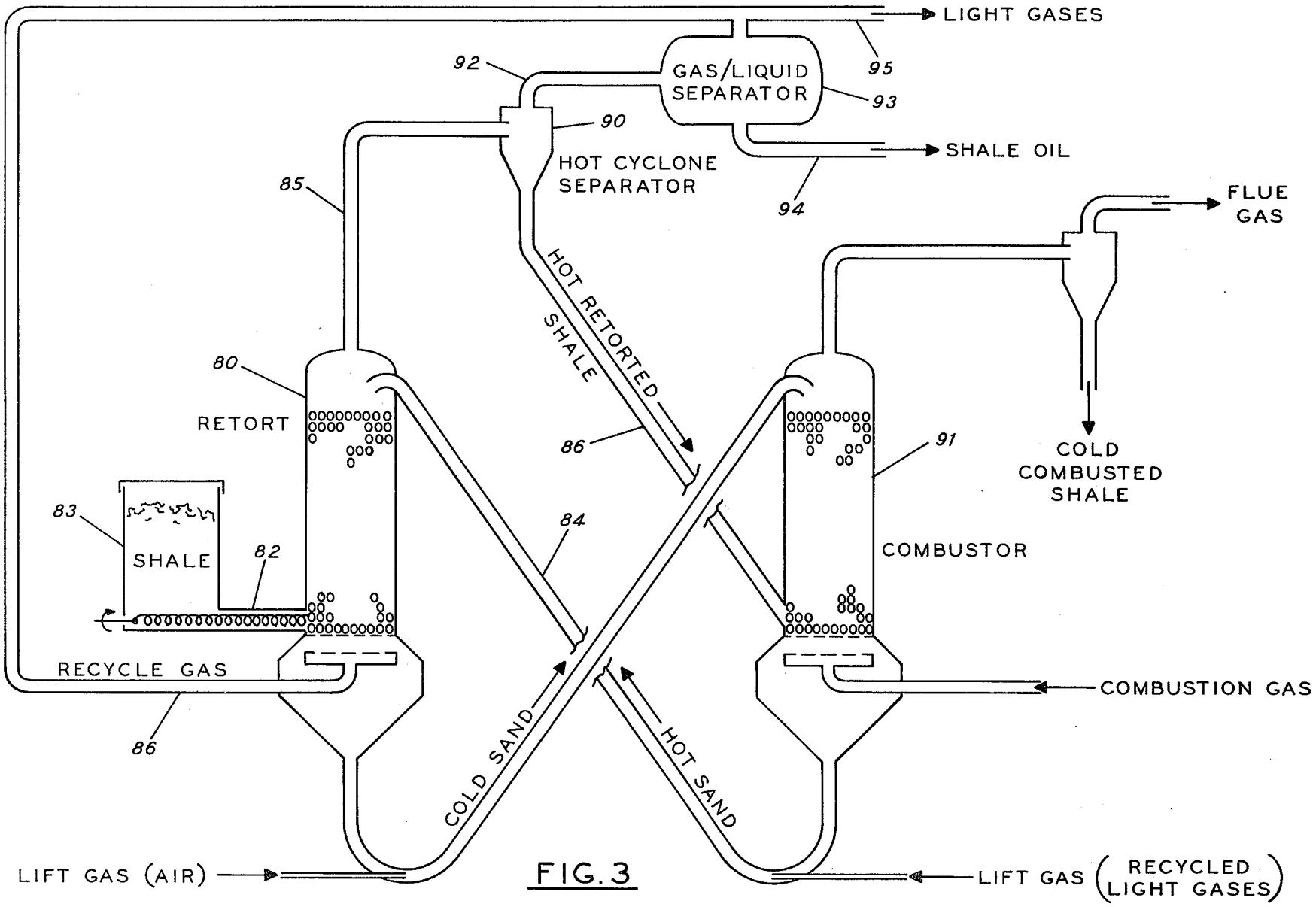
FIG. 3 is a schematic process flow diagram illustrating a preferred embodiment of the invention as it applies to the retorting of shale.

Referring now to FIG. 3, there is shown a preferred embodiment of the invention as it applies to the retorting of a solid carbonaceous material. The embodiment depicted in FIG. 3 is particularly adapted to the retorting of shale. Appropriately sized shale is fed into a lower portion of a retorting vessel 80 via line 82 from storage 83. Hot sand or some other fluidizable heat-transfer material is fed into an upper portion of the vessel 80 via line 84. A relatively inert fluidizing gas, preferably recycle gas, is introduced at a lower portion of the retorting vessel via line 86 at a rate sufficient to fluidize the sand and entrain the shale through the retorting zone in the vessel 80. The physical characteristics, particularly the shape, size or density of the shale and heat-transfer material, are sufficiently different, as discussed above, to allow for fluidization of the sand and entrainment of the shale in the fluidizing gas. As the shale passes upwardly through the retorting zone, it is heated by the downflowing hot sand and at least a portion or all of the volatile components present in the shale are vaporized or liquefied. Fluid product and entrained solids are removed from the retort via line 85. Hot spent shale or partially spent shale is passed to the combustor via line 86 from hot cyclone separator 90 and the remaining fixed carbon or residual hydrocarbons in the partially spent shale are combusted to reheat the cold heat-transfer material in substantially the same manner as described with regard to combustor 65 in FIG. 2. The fluid product stream removed via line 92 from cyclone separator 90 is passed to gas-liquid separation zone 93, in which shale oil is separated. The oil is removed via line 94 and light gases are removed via line 95. A portion of the light gases is recycled via line 86 to the retort to fluidize fresh shale. A portion of the light gases can also be used as a lift gas to convey the reheated sand from the bottom of combustor 91 to the top of the retort via line 84.

The present invention as it applies to the retorting of solid carbonaceous materials, including coal, has many advantages over the prior art in addition to those previously mentioned. For example, because of the countercurrent plug flow of both solids, retorted shale or other carbonaceous material contacts the hottest sand last as the retorting takes place in the retorting zone. This increases the shale oil yield by preventing the readsorption of shale on the retorted shale.

Coal may also be retorted according to the embodiment shown in FIG. 3. The present invention is particularly useful with caking coals because the high-velocity, substantially inert gas used, and the intimate contacting of the coal with the heat carrier provided, help prevent caking of the coal.

Representative reaction conditions for the preferred embodiments of the process illustrated in FIGS. 2 and 3 appear in Table I. The retorting and reaction conditions in the vessel can vary widely, depending on many interrelated factors, including: the type of carbonaceous material, the type of heat-transfer material, temperature, pressure, fluidization gas composition and velocity, and the particular means provided for impeding back mixing of solids in the contacting zone, e.g., the type and size of packing material. Those parameters can readily be adjusted by any person skilled in the art to obtain specific desired results.

TABLE I

| | TYPE OF OPERATION | | | | | |
|---|---|---|---|---|---|---|
| | Retorting of Shale | | Endothermic Gasification of Coal | | Exothermic Gasification of Char or Spent Shale | |
| PARAMETER | Broad Range | Preferred Range | Broad Range | Preferred Range | Broad Range | Preferred Range |
| SOLID CARBONACEOUS MATERIAL | | | | | | |
| - Inlet Temperature, °F. | 0–500 | 0–100 | 0–500 | 0–100 | 500–2500 | 800–2000 |
| - Outlet Temperature, °F. | 500–1200 | 800–1000 | 1200–2500 | 1200–2000 | 0–1000 | 200–600 |
| - Size, inches | .001–.035 | .001–.01 | .001–.035 | .001–.01 | .001–.035 | .001–.01 |
| - Residence Time, sec. | 5–120 | 5–50 | 20–240 | 100–200 | 5–120 | 5–50 |
| - Linear Velocity, ft/sec. | .05–10 | 0.3–3 | .05–1.0 | .1–.2 | .05–10 | 0.3–3 |
| HEAT TRANSFER MATERIAL | | | | | | |
| - Inlet Temperature, °F. | 500–1200 | 800–1200 | 1200–2500 | 1200–2000 | 0–1000 | 0–500 |
| - Outlet Temperature, °F. | 0–1000 | 0–500 | 0–1000 | 0–500 | 500–2500 | 800–2000 |
| - Size, inches | .015–.5 | .015–.05 | .015–.5 | .015–.05 | .015–.05 | .015–.05 |
| - Residence Time, sec. | 5–240 | 20–100 | 5–240 | 20–100 | 5–240 | 20–100 |
| - Linear Velocity, ft/sec. | .05–5 | .15–1.0 | .05–5 | 0.15–1.0 | 0.05–5 | .15–1.0 |
| FLUIDIZATION GAS | | Recycle Gas | Steam | | Air | |
| - Inlet Temperature, °F. | 500–1200 | 500–800 | 32–700 | 300–500 | 0–500 | 0–100 |
| - Outlet Temperature, °F. | 500–1200 | 800–1000 | 1200–2500 | 1200–2000 | 0–1000 | 200–600 |
| - Velocity, ft/sec. | 1–20 | 2–8 | 1–20 | 2–8 | 1–20 | 2–8 |
| Pressure, psig. | 0–100 | 0–10 | 0–500 | 75–250 | 0–500 | 0-250 |

The foregoing FIGS. 1–3 illustrate various specific embodiments of the invention. The process of the present invention may, of course, be more broadly adapted to provide intimate contacting of two or more solids and a fluid in any appropriate system wherein such contacting is advantageous. The fluid may be reactive or inert and be a gas or liquid. The present invention may be advantageously utilized in many systems wherein it is desired to effect a physical and/or chemical change in the fluidizing medium, whether gas of liquid, or in one or more of the countercurrently flowing solids. The present invention may be readily adapted to many existing processes wherein conventional fluidization technology is already in use, for example, heat-transfer, heat-treating, solids coating, drying, solids agglomeration and attrition; chemical reactions, for example, oxidation, chlorination, nitration, hydrogenation, dehydrogenation, cracking, isomerization, alkylation, polymerization, etc. The invention will also find application in scrubbing processes and ion exchange. The process of the present invention can readily be adapted to the above-mentioned processes and many others by any person skilled in the art, and various alternatives, equivalents and modifications of the embodiments described above will be apparent to those skilled in the art from the foregoing description. Accordingly, the scope of the present invention is not to be construed as limited to the specific embodiments or examples discussed but only as defined in the appended claims or substantial equivalents of the claims.

What is claimed is:

1. A process for gasifying a solid carbonaceous material in a vertically elongated vessel, said vessel including means for substantially impeding vertical back mixing of vertically moving solids substantially throughout said vessel, which comprises:

(1) introducing into an upper portion of said vessel a first particulate solid comprising a solid heat-transfer material;

(2) introducing into a lower portion of said vessel a second particulate solid comprising a solid carbonaceous material, the physical characteristics of said first solid and second solid differing such that a superficial velocity of a fluid flowing upwardly through said vessel is greater than the minimum fluidizing velocity of said first solid and less than the terminal velocity of said first solid while said superficial velocity is greater than the terminal velocity of said second solid;

(3) maintaining substantially countercurrent vertical flow of said first and second solids in said vessel without substantial top-to-bottom back mixing of said first and second solids in said vessel by passing a reactive gas stream including a reactive component upwardly through said vessel at a rate sufficient to fluidize said first solid and entrain said second solid and forming a fluid product and an at least partially gasified solid carbonaceous material by reacting said second solid with said reactive component, whereby said first solid substantially flows downwardly in a fluidized state through said vessel and said second solid substantially flows upwardly in an entrained state through said vessel, and said first and second solids pass through said vessel in countercurrent plug flow;

(4) removing from a lower end of said vessel said heat-transfer material at a temperature substantially different from the temperature at which said heat-transfer material was introduced into said vessel; and (5) removing from an upper end of said vessel said product fluid and said at least partially gasified solid.

2. The process of claim 1 wherein said carbonaceous material is coal, said reactive gas stream includes steam and said heat-transfer material is introduced into said vessel at an elevated temperature and removed from said vessel at a substantially lower temperature.

3. A process in accordance with claim 1 wherein said reactive gas stream includes free oxygen, heat is generated by combusting said carbonaceous material in said vessel and the temperature of said heat-transfer material is substantially increased in said vessel.

4. A process in accordance with claim 1 wherein said reactive gas stream includes recycled product fluid and said second solid is introduced into said vessel in association with liquid water, said liquid water being vaporized and reacting with said second solid as said second solid flows upwardly through said vessel.

5. A process in accordance with claim 4 wherein said second solid is introduced into said vessel as a water-slurry mixture and water vaporizes and reacts with said second solid as said second solid flows upwardly through said vessel.

6. A process in accordance with claim 1 wherein said second solid is partially gasified in said vessel and said partially gasified solid is combusted after removal from said vessel.

7. A process in accordance with claim 1 wherein said means for impeding back mixing includes packing material, said packing material substantially filling said vessel.

8. A process in accordance with claim 1 wherein said reactive gaseous fluid comprises steam, said solid carbonaceous material is coal, said coal is partially gasified in said vessel, producing a hot char and a cooled heat-transfer material, and said cooled heat-transfer material is heated to an elevated temperature by;

(1) introducing at least a portion of said cooled heat-transfer material into an upper portion of a vertically elongated combustion zone, said combustion zone including means for substantially impeding vertical back mixing of vertically moving solids substantially throughout said combustion zone;

(2) introducing at least a portion of said hot char into a lower portion of said combustion zone;

(3) heating said cooled heat-transfer material to an elevated temperature by contacting said hot char with said heat-transfer material in said combustion zone, maintaining substantially countercurrent plug flow of said heat-transfer material and said char in said combustion zone by passing an oxygen-containing fluidization and combustion gas upwardly through said combustion zone at a rate sufficient to fluidize said heat-transfer material and entrain said char, whereby said heat-transfer material substantially flows downwardly through said combustion zone in a fluidized state and is heated to an elevated temperature while said char substantially flows upwardly through said combustion zone in an entrained state and is combusted.

9. A process for retorting a solid carbonaceous material in a vertically elongated retorting vessel, said retorting vessel including means for substantially impeding vertical back mixing of vertically moving solids substantially throughout said retorting vessel, which comprises:

(1) introducing at an elevated temperature into an upper portion of said retorting vessel a first solid comprising a solid heat-transfer material;

(2) introducing into a lower portion of said retorting vessel a second solid comprising a solid carbonaceous material, the physical characteristics of said first and second solids differing such that a superficial velocity of a fluid flowing upwardly through said retorting vessel is greater than the minimum fluidizing velocity of said first solid in said fluid and less than the terminal velocity of said first solid in said fluid while said superficial velocity is greater than the terminal velocity of said second solid;

(3) maintaining substantially countercurrent vertical flow of said first and second solids in said retorting vessel without substantial top-to-bottom back mixing of solids in said retorting vessel by passing a gaseous stream upwardly through said retorting vessel at a rate sufficient to fluidize said first solid and entrain said second solid, whereby said first solid substantially flows downwardly in a fluidized state through said retorting vessel in plug flow and is cooled by contact with said gaseous stream while said second solid substantially flows upwardly in an entrained state through said retorting vessel in plug flow countercurrent to said first solid and is heated sufficiently to form an at least partially retorted solid and a fluid product;

(4) removing from a lower end of said retorting vessel a cooled heat-transfer material;

(5) removing from an upper end of said retorting vessel said fluid product and said at least partially retorted solid.

10. A process in accordance with claim 9 wherein said gaseous stream comprises a portion of said product fluid.

11. A process in accordance with claim 9 wherein said gaseous stream contains essentially no molecular oxygen.

12. A process in accordance with claim 9 wherein said carbonaceous material is selected from the group consisting of coal, tar sand and shale.

13. A process in accordance with claim 9 wherein said solid carbonaceous material is shale, said partially retorted solid comprises retorted shale containing carbon, and at least a portion of the heat necessary to heat the cooled heat-transfer material is provided by combusting said carbon-containing retorted shale with an oxygen-containing gas.

14. A process in accordance with claim 9 wherein said means for impeding back mixing includes packing material, said packing material substantially filling said retorting vessel.

15. A process in accordance with claim 13 wherein said cooled heat-transfer material is heated to an elevated temperature by:

(1) introducing at least a portion of said cooled heat-transfer material into an upper portion of a vertically elongated combustion zone, said combustion zone including means for substantially impeding vertical back mixing of vertically flowing solids;

(2) introducing at least a portion of said retorted shale into a lower portion of said combustion zone;

(3) maintaining substantially countercurrent plug flow of said heat-transfer material and said partially retorted shale in said combustion zone by passing an oxygen-containing fluidization and combustion gas upwardly through said combustion zone at a rate sufficient to entrain said partially retorted shale and fluidize said heat-transfer material, whereby said heat-transfer material substantially flows downwardly in a fluidized state through said combustion zone and is heated to an elevated temperature while said partially retorted shale substantially flows upwardly in an entrained state through said combustion zone and is combusted.

16. A method for contacting two solids in a vertically elongated vessel, said vessel including means for substantially impeding vertical back mixing of vertically flowing solids substantially throughout said vessel, which comprises:

(1) introducing into an upper portion of said vessel a first solid;

(2) introducing into a lower portion of said vessel a second solid, the physical characteristics of said first and second solids differing such that the superficial velocity of a fluid flowing upwardly through said vessel is greater than the minimum fluidizing velocity and less than the terminal velocity of said first solid in said fluid while the superficial velocity of said fluid is greater than the terminal velocity of said second solid;

(3) maintaining substantially countercurrent vertical flow of said first and second solids in said vessel without substantial top-to-bottom mixing of solids in said vessel by passing said fluid stream upwardly through said zone at a rate sufficient to fluidize said first solid and entrain said second solid, whereby said first solid substantially flows downwardly in a fluidized state through said vessel in plug flow while said second solid substantially flows upwardly in an entrained state through said vessel in plug flow and contacts said first solid;

(4) removing from a lower end of said vessel said first solid; and (5) removing from an upper end of said vessel said fluid stream and said second solid.

17. A method according to claim 16 wherein said means for impeding back mixing includes packing material and said contacting vessel is substantially filled with said packing material.

18. A process for the gasification of a solid carbonaceous material in a vertically elongated gasification vessel substantially completely filled with a packing material, which comprises:

(1) introducing into an upper portion of said gasification vessel a first solid comprising a solid heat-transfer material;

(2) introducing into a lower portion of said gasification vessel a second solid comprising a solid carbonaceous material wherein the physical characteristics of said first and second solid differ such that the superficial velocity of a fluid flowing through said vessel is greater than the minimum fluidizing velocity of said first solid in said fluid and less than the terminal velocity of said first solid in said fluid while the superficial velocity of said fluid is greater than the terminal velocity of said second solid in said fluid;

(3) maintaining substantially countercurrent plug flow of said first and second solids in said vessel by passing a reactive gaseous fluid upwardly through said vessel at a rate sufficient to fluidize said first solid and entrain said second solid whereby said first solid substantially flows downwardly in a fluidized state through said vessel while said second solid substantially flows upwardly in an entrained state through said vessel and reacts with said reactive gaseous fluid forming a fluid product and an at least partially gasified solid carbonaceous material;

(4) removing from a lower portion of said vessel said heat-transfer material at a temperature substantially different than the temperature at which said heat-transfer material was introduced into said vessel; and (5) removing from an upper portion of said vessel said product fluid and said at least partially gasified solid.

19. The process of claim 18 wherein said solid carbonaceous material is coal and said reactive gaseous fluid comprises steam and said heat-transfer material is introduced into said vessel at an elevated temperature and removed from said vessel at a substantially lower temperature.

20. The process of claim 18 wherein said reactive gaseous fluid comprises a free oxygen-containing gas and said carbonaceous material is combusted in said vessel producing heat and said heat-transfer material is removed from said vessel at a temperature substantially higher than the introduction temperature of said heat-transfer material.

21. The process of claim 18 wherein at least a portion of said reactive gaseous fluid comprises recycled product gas and said second solid contains water which vaporizes and reacts with said second solid as said second solid flows upwardly through said vessel.

22. The process of claim 18 wherein said second solid is introduced into said gasification vessel as a water-slurry mixture and said water vaporizes and reacts with said second solid as said second solid flows upwardly through said vessel.

23. The process of claim 18 wherein said second solid is partially gasified in said gasification vessel and said partially gasified solid is combusted after removal from said gasification vessel.

24. The process of claim 18 wherein said reactive gaseous fluid comprises steam and said solid carbonaceous material is coal, and said coal is partially gasified in said gasification vessel producing a hot char, and a cooled heat transfer material, and said cooled heat-transfer material is heated to an elevated temperature by:

(1) introducing at least a portion of said cooled heat-transfer material into an upper portion of a combustion vessel substantially completely filled with a packing material;

(2) introducing at least a portion of said hot char into a lower portion of said combustion vessel;

(3) heating said cooled heat-transfer material to an elevated temperature by contacting said hot char with said heat-transfer material and combustion gases by maintaining substantially countercurrent plug flow of said heat-transfer material and said char by passing an oxygen-containing fluidization and combustion gas upwardly through said combustion vessel at a rate sufficient to fluidize said heat-transfer material and entrain said char whereby said heat-transfer material substantially flows downwardly in a fluidized state through said combustion vessel and is heated to an elevated temperature while said char substantially flows upwardly in an entrained state through said combustion vessel and is combusted.

25. A process for retorting a solid carbonaceous material in a vertically elongated retorting vessel substantially completely filled with a packing material, which comprises:

(1) introducing at an elevated temperature into an upper portion of said retorting vessel a first solid comprising a solid heat-transfer material;

(2) introducing into a lower portion of said retorting vessel a second solid comprising a solid carbonaceous material wherein the physical characteristics of said first and second solids differ such that the superficial velocity of a fluid flowing through said vessel is greater than the minimum fluidizing velocity of said first solid in said fluid and less than the terminal velocity of said first solid in said fluid while the superficial velocity of said fluid is greater than the terminal velocity of said second solid;

(3) maintaining substantially countercurrent plug flow of said first and second solids in said vessel by passing a gaseous fluid upwardly through said vessel at a rate sufficient to fluidize said first solid and entrain said second solid whereby said first solid substantially flows downwardly in a fluidized state through said vessel and is cooled by contact with said gaseous fluid while said second solid substantially flows upwardly in an entrained state through said vessel and is heated, producing an at least partially retorted solid and a fluid product;

(4) removing from a lower portion of said vessel a cooled heat-transfer material;

(5) removing from an upper portion of said vessel said fluid product and an at least partially retorted solid.

26. The process of claim 25 wherein said gaseous fluid comprises a portion of said product fluid.

27. The process of claim 25 wherein said gaseous fluid contains essentially no molecular oxygen.

28. The process of claim 25 wherein said carbonaceous material is selected from the group consisting of coal, tar sand and shale.

29. The process of claim 25 wherein said solid carbonaceous material is shale and said partially retorted solid comprises retorted shale containing carbon and at least a portion of the heat necessary to heat the cooled heat-transfer material to an elevated temperature is provided by combusting said carbon-containing retorted shale with an oxygen-containing gas.

30. The process of claim 29 wherein said cooled heat-transfer solid is heated to an elevated temperature by:

(1) introducing at least a portion of said cooled heat-transfer solid into an upper portion of a combustion vessel substantially completely filled with a packing material;

(2) introducing at least a portion of said retorted shale into a lower portion of said combustion vessel;

(3) maintaining substantially countercurrent plug flow of said heat-transfer material and said partially retorted shale in said combustion vessel by passing an oxygen-containing fluidization and combustion gas upwardly through said combustion vessel at a rate sufficient to entrain said partially retorted shale and fluidize said heat-transfer material whereby said heat-transfer material substantially flows downwardly in a fludized state through said combustion vessel and is heated to an elevated temperature while said partially retorted shale substantially flows upwardly in an entrained state through said combustion vessel and is combusted.

31. A process for contacting two solids in a vertically elongated vessel substantially completely filled with a packing material, which comprises:

(1) introducing into an upper portion of said vessel a first solid;

(2) introducing into a lower portion of said vessel a second solid wherein the physical characteristics of said first and second solids differ such that the superficial velocity of a fluid flowing through said vessel is greater than the minimum fluidizing velocity of said first solid in said fluid and less than the terminal velocity of said first solid in said fluid while the superficial velocity of said fluid is greater than the terminal velocity of said second solid;

(3) maintaining substantially countercurrent plug flow of said first and second solids in said vessel by passing said fluid upwardly through said vessel at a rate sufficient to fluidize said first solid and entrain said second solid whereby said first solid substantially flows downwardly in a fluidized state through said vessel while said second solid substantially flows upwardly in an entrained state through said vessel and contacts said first solid;

(4) removing from a lower portion of said vessel said first solid; and (5) removing from an upper portion of said vessel said fluid and said second solid.

32. The process of claim 18 wherein said packing material comprises pall rings.

33. The process of claim 25 wherein said packing material comprises pall rings.

* * * * *